US007055356B2

(12) United States Patent
Tsuritani

(10) Patent No.: US 7,055,356 B2
(45) Date of Patent: Jun. 6, 2006

(54) WIRE ROD CUTTING APPARATUS OF SPRING MANUFACTURING MACHINE

(75) Inventor: Katsuhide Tsuritani, Osaka (JP)

(73) Assignee: Shinko Machinery Co., Ltd., Osaka (JP)

( * ) Notice: Subject to any disclaimer, the term of this patent is extended or adjusted under 35 U.S.C. 154(b) by 184 days.

(21) Appl. No.: 10/847,284

(22) Filed: May 18, 2004

(65) Prior Publication Data

US 2005/0016347 A1 Jan. 27, 2005

(30) Foreign Application Priority Data

Jul. 22, 2003 (JP) ..... 2003-277223

(51) Int. Cl.
*B21F 11/00* (2006.01)

(52) U.S. Cl. ..... 72/132; 72/129; 83/907

(58) Field of Classification Search ..... 72/132, 72/135, 129; 83/907, 321, 315, 327
See application file for complete search history.

(56) References Cited

U.S. PATENT DOCUMENTS 6,178,862 B1 * 1/2001 Liao ..... 83/628

FOREIGN PATENT DOCUMENTS

JP 7-115101 12/1995
JP 8-15635 2/1996

* cited by examiner

*Primary Examiner*—Derris H. Banks
*Assistant Examiner*—Debra Wolfe
(74) *Attorney, Agent, or Firm*—Rabin & Berdo, P.C.

(57) ABSTRACT

To easily adjust and change a locus of a leading end (an endless locus) of a cutter, a wire rod cutting apparatus of spring manufacturing machine has structure so that a slide may vertically slide via a connection rod by rotating a rotation shaft, and a cutter mounting oscillating arm can oscillate laterally via a sliding element by oscillating the connection rod, so that the locus thereof in the oscillating arm can be set to a predetermined shape (refer to a two-dot chain line in FIG. 1) which is endless in a front view and different between an outward and a homeward routes, by sliding the slide and oscillating the oscillating arm by actuation of the actuating apparatus and that a lateral oscillating amount of the oscillating arm can be changed by changing the position of the sliding element, to change the locus of the cutter leading end.

1 Claim, 4 Drawing Sheets

WIRE ROD CUTTING APPARATUS OF SPRING MANUFACTURING MACHINE

TECHNICAL FIELD

The present invention relates to a wire rod cutting apparatus of a spring manufacturing machine.

BACKGROUND ART

In conventional, the following structure has been known as this kind of wire rod cutting apparatus.

There has been known a wire rod cutting apparatus of a spring manufacturing machine for manufacturing a spring by discharging a wire rod to a wire rod processing space provided in front of a front wall of a machine casing from a final wire rod guide provided in the front wall, and applying a predetermined process to the wire rod which is discharged to the wire rod processing space or is going to be discharged to the wire rod processing space, by a tool which protrudes or is protruding to the wire rod processing space, wherein the wire rod cutting apparatus has a slide which is slidably provided in the front wall in such a manner as to slide in the direction orthogonal to a center line of a wire rod passage of the final wire rod guide, a cutter mounting oscillating arm which is provided in the slide so as to freely oscillate by a pivot shaft having an axis directed to the longitudinal direction, and an actuating apparatus which slides the slide and oscillates the cutter mounting oscillating arm.

Said wire rod cutting apparatus slides the slide and oscillates the cutter mounting oscillating arm by the actuating apparatus, and thus can set a locus of a leading end of a cutter provided in the cutter mounting oscillating arm to a predetermined shape which is different between an outward route and a homeward route and is endless in a front view (as seen from a state of normally facing to the front wall).

Patent Document 1

Japanese Patent Publication No. 8-15635

Patent Document 2

Japanese Patent Publication No. 7-115101

DISCLOSURE OF THE INVENTION

The conventional wire rod cutting apparatus mentioned above has the following defect.

In order to cut the wire rod without "burrs" being generated, in the cutting process of the wire rod for forming the spring, it is necessary to adjust and change the locus of the leading end of the cutter (the endless locus) while taking into consideration a raw material of the wire rod, a diameter of the wire rod and the like. However, there is a defect that the conventional wire rod cutting apparatus can not easily adjust and change the locus.

In order to solve the defect mentioned above, the present invention employs the following means.

In accordance with a first aspect of the present invention, there is provided a wire rod cutting apparatus of a spring manufacturing machine for manufacturing a spring by discharging a wire rod to a wire rod processing space provided in front of a front wall of a machine casing from a final wire rod guide provided in the front wall, and applying a predetermined process to the wire rod which is discharged to the wire rod processing space or is being discharged to the wire rod processing space, by a tool which protrudes or is protruding to the wire rod processing space, wherein the wire rod cutting apparatus has a slide which is slidably provided in the front wall in such a manner as to slide in the direction orthogonal to a center line of a wire rod passage of the final wire rod guide, a cutter mounting oscillating arm which is provided in the slide so as to freely oscillate by a pivot shaft having an axis directed in the longitudinal direction, and an actuating apparatus which slides the slide and oscillates the cutter mounting oscillating arm, wherein the actuating apparatus has a rotation shaft which is in parallel to the pivot shaft, an eccentric pin which is directly or indirectly provided in the rotation shaft, is eccentric from the center of the rotation shaft and is in parallel to the rotation shaft, a connection rod which is pivotally attached to the eccentric pin in one end, and a connection pin which is provided in the slide in parallel to the eccentric pin and is pivotally attached to the other end of the connection rod, wherein a sliding element is provided in any one of the connection rod and the cutter mounting oscillating arm portion opposing to the connection rod, and a guide groove to which the sliding element is fitted with no play in the width direction is formed in the other thereof, wherein one end of the guide groove is directed to the eccentric pin and the other end thereof is directed to the pivot shaft, and wherein the sliding element is changeable in position so as to allow to change a distance with respect to the pivot shaft.

The present invention can achieve the following effect on the basis of the structure mentioned above.

In accordance with the invention of the first aspect, it is possible to easily adjust and change the locus of the leading end of the cutter (the endless locus) by changing the position of the sliding element.

DESCRIPTION OF REFERENCE NUMERALS

Figure 1:
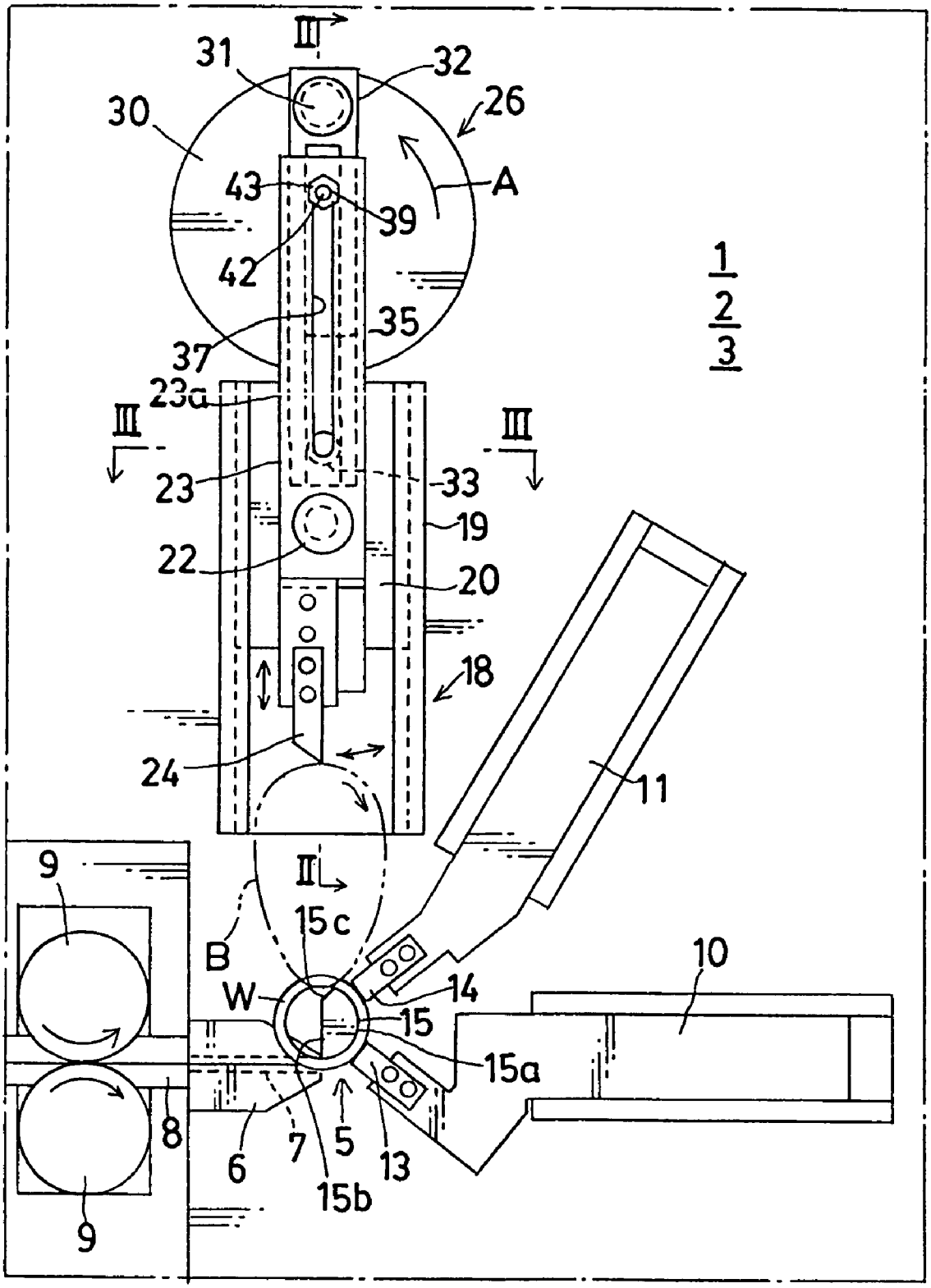
FIG. 1 is a front view of a main portion showing an embodiment in accordance with the present invention.

1 spring manufacturing machine
2 machine casing
3 front wall
5 wire rod processing space
6 final wire rod guide
7 wire rod passage
9 wire rod feeding roller
18 wire rod cutting apparatus
20 slide
22 pivot shaft
23 cutter mounting oscillating arm
23*a* upper portion
24 cutter
26 actuating apparatus
28 motor
29 rotation shaft
30 disc
31 eccentric pin
32 connection rod
33 connection pin
35 guide groove
40 sliding element

BEST MODE FOR CARRYING OUT THE INVENTION

A description will be given below of an embodiment in accordance with the present invention.

In this case, in the description, front means the top side of a paper surface in FIG. 1, rear means the back side thereof, left means the left side in FIG. 1 and right means the right side in FIG. 1.

A spring manufacturing machine 1 has a machine casing 2 which has a vertical front wall 3, a wire rod processing space 5 which is formed in front of the front wall 3 in the machine casing 2, a final wire rod guide 6 which has a wire rod passage 7 passing a wire rod W discharged toward the wire rod processing space 5 therethrough and is provided in the front wall 3, at least one pair of wire rod feeding rollers 9 which are rotatably provided in the front wall in the opposite side to the wire rod processing space 5 in the final wire rod guide 6, and discharge the wire rod W while pinching the wire rod W, a first bending die slide 10 which is opposed to the final wire rod guide 6 beyond the wire rod processing space 5 and is provided in the front wall 3 so as to move close to and apart from the wire rod processing space 5, and a second bending die slide 11 which is opposed to the final wire rod guide 6 beyond the wire rod processing space 5 and is provided in the front wall 3 so as to freely move close to and apart from the wire rod processing space 5. In this case, positions of the first bending die slide 10 and the second bending die slide 11 are adjusted by a known actuating apparatus (not shown).

An auxiliary wire rod guide 8 is provided in the front wall 3 between the final wire rod guide 6 and the wire rod feeding roller 9.

A first bending die 13 is mounted to an end portion of the first bending die slide 10 in the side of the wire rod processing space 5, and a second bending die 14 is mounted to an end portion of the second bending die slide 11 in the side of the wire rod processing space 5.

A core bar 15 is provided in the front wall 3 so as to protrude to the front side and to be positioned in the wire rod processing space 5. The core bar 15 has an arc surface 15*a* which is protruded toward the first bending die 13 and the second bending die 14 in a front view, a vertical surface 15*b* in the side of the final wire rod guide 6, and a slope surface 15*c* which connects the upper end of the vertical surface 15*b* to the upper end of the arc surface 15*a* and is inclined downward toward the final wire rod guide 6.

As is well known, the wire rod W discharged from the final wire rod guide 6 is bent by the first bending die 13 and the second bending die 14.

A wire rod cutting apparatus 18 is provided in the front wall 3 so as to be positioned above the wire rod processing space 5.

The wire rod cutting apparatus 18 has a slide 20 which is guided by a guide member 19 provided in the front wall 3 and is slidable in the direction orthogonal to a center line of the wire rod passage 7 of the final wire rod guide 6, a cutter mounting oscillating arm 23 which is slidably provided in the slide 20 by a pivot shaft 22 having an axis directed to the longitudinal direction, and an actuating apparatus 26 which slides the slide 20 and oscillates the cutter mounting oscillating arm 23.

A cutter 24 is mounted to the end of the cutter mounting oscillating arm 23 in the side of the wire rod processing space 5.

Figure 2:
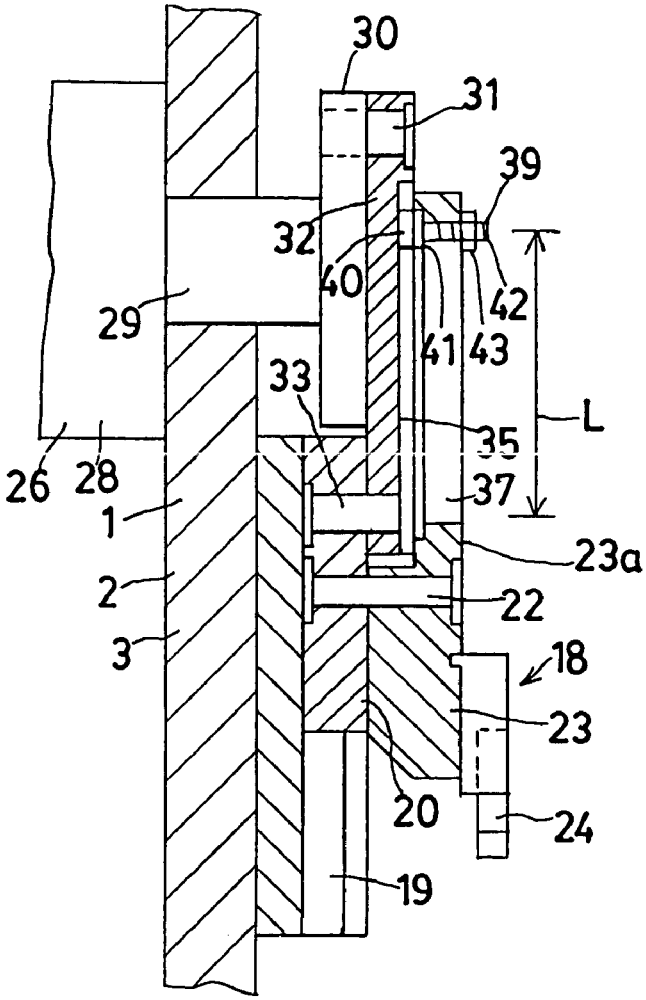
FIG. 2 is a cross sectional view along a line II—II in FIG. 1.

The actuating apparatus 26 has a motor 28 which is mounted to the rear surface of the front wall 3 so as to direct an axis of a reversibly rotating rotation shaft 29 in the longitudinal direction, that is, in parallel to the pivot shaft 22. As shown in FIG. 2, the rotation shaft 29 protrudes to the front side of the front wall 3 through the front wall 3, a disc 30 is mounted to the front end of the rotation shaft 29, and an eccentric pin 31 is provided in the disc 30 in parallel to the rotation shaft 29 so as to be positioned at a position eccentric from the center of the rotation shaft 29.

A connection rod 32 is pivotally attached to the eccentric pin 31, and the other end of the connection rod 32 is pivotally attached to a connection pin 33 which is provided in the slide 20 in parallel to the eccentric pin 31. A guide groove 35 is formed in the connection rod 32 along the connection rod 32. One end of the guide groove 35 is directed to the eccentric pin 31, and the other end of the guide groove 35 is directed to the pivot shaft 22.

A slit 37 in the longitudinal direction is formed in an upper portion 23*a* of the cutter mounting oscillating arm 23 in the upper side than the pivot shaft 22 (in a portion of the cutter mounting oscillating arm 23 opposing to the connection rod 32). One end of the slit 37 is directed to the eccentric pin 31, and the other end of the slit 37 is directed to the pivot shaft 22. A sliding member 39 is provided along the slit 37 so as to be freely changed in position. In this case, a moving distance of the sliding member 39 is denoted by reference symbol "L" in FIG. 2. The sliding member 39 has a sliding element 40 which is fitted to the guide groove 35 with no play in the width direction, a flange 41 to which the sliding element 40 is rotatably mounted, a screw 42 which is provided in the flange 41 so as to protrude to the front side through the slit 37, and a nut 43 which is fitted to the screw 42. The sliding member 39 (the sliding element 40) can be fixed at a predetermined position in the state in which an edge portion of the slit 37 is clamped by the flange 41 and the nut 43, by adjusting the position of the sliding member 39 in the state in which the nut 43 is loosened, and thereafter fastening the nut 43.

In accordance with the structure mentioned above, it is possible to vertically slide the slide 20 via the connection rod 32 on the basis of the rotation of the rotation shaft 29 (the rotation in the direction of an arrow A in FIG. 1). Further, it is possible to oscillate the cutter mounting oscillating arm 23 laterally via the sliding element 40 on the basis of the oscillation of the connection rod 32. In other words, it is possible to set the locus of the leading end of the cutter 24 provided in the cutter mounting oscillating arm 23 to a predetermined shape (refer to a two-dot chain line in FIG. 1) which is endless in a front view (as seen from a state normally facing to the front wall 3) and is different between an outward route and a homeward route, by sliding the slide 20 and oscillating the cutter mounting oscillating arm 23 on the basis of an actuation of the actuating apparatus 26. Further, it is possible to change a lateral oscillating amount of the cutter mounting oscillating arm 23 by changing the position of the sliding element 40, whereby it is possible to change the locus of the leading end of the cutter 24. In this case, if the center of the sliding element 40 is aligned with the center of the pivot shaft 22, the cutter mounting oscillating arm 23 is not absolutely oscillated.

Figure 3:
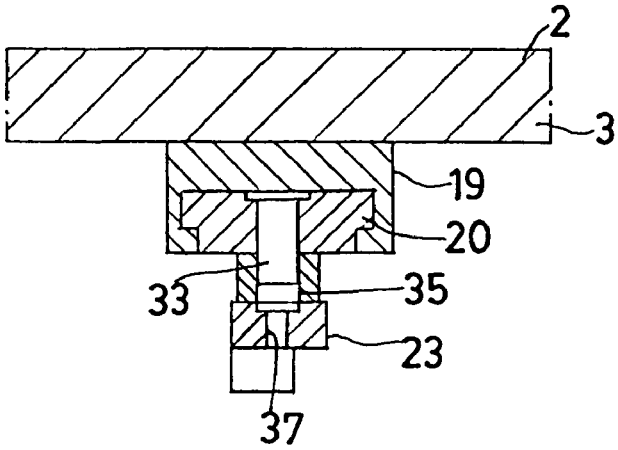
FIG. 3 is a cross sectional view along a line III—III in FIG. 1.
Figure 4:
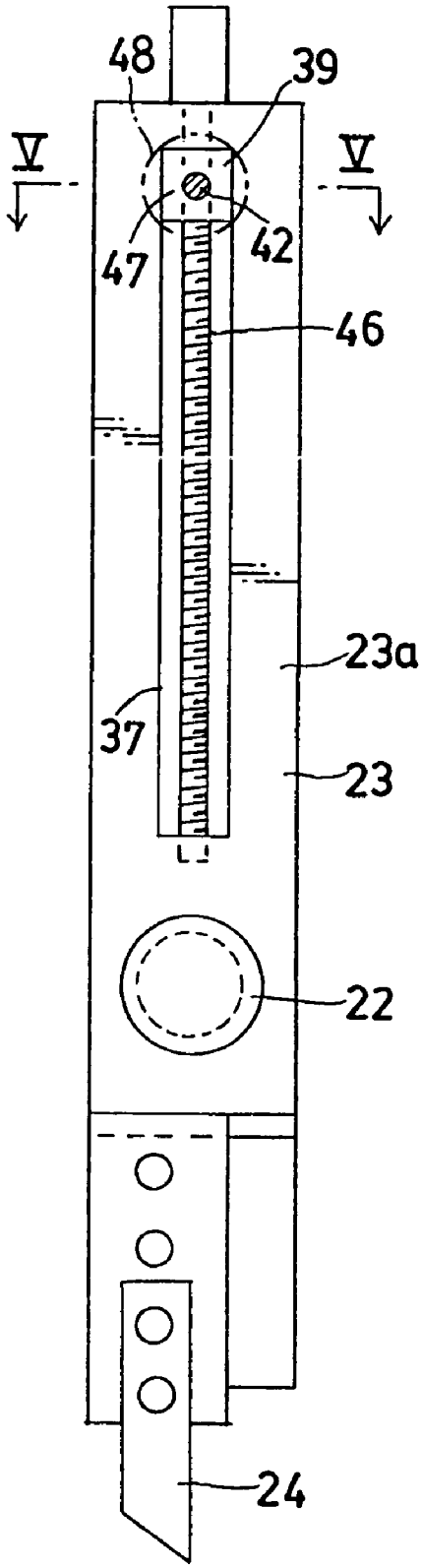
FIG. 4 is a front view showing a modified embodiment of a cutter mounting oscillating arm.
Figure 5:
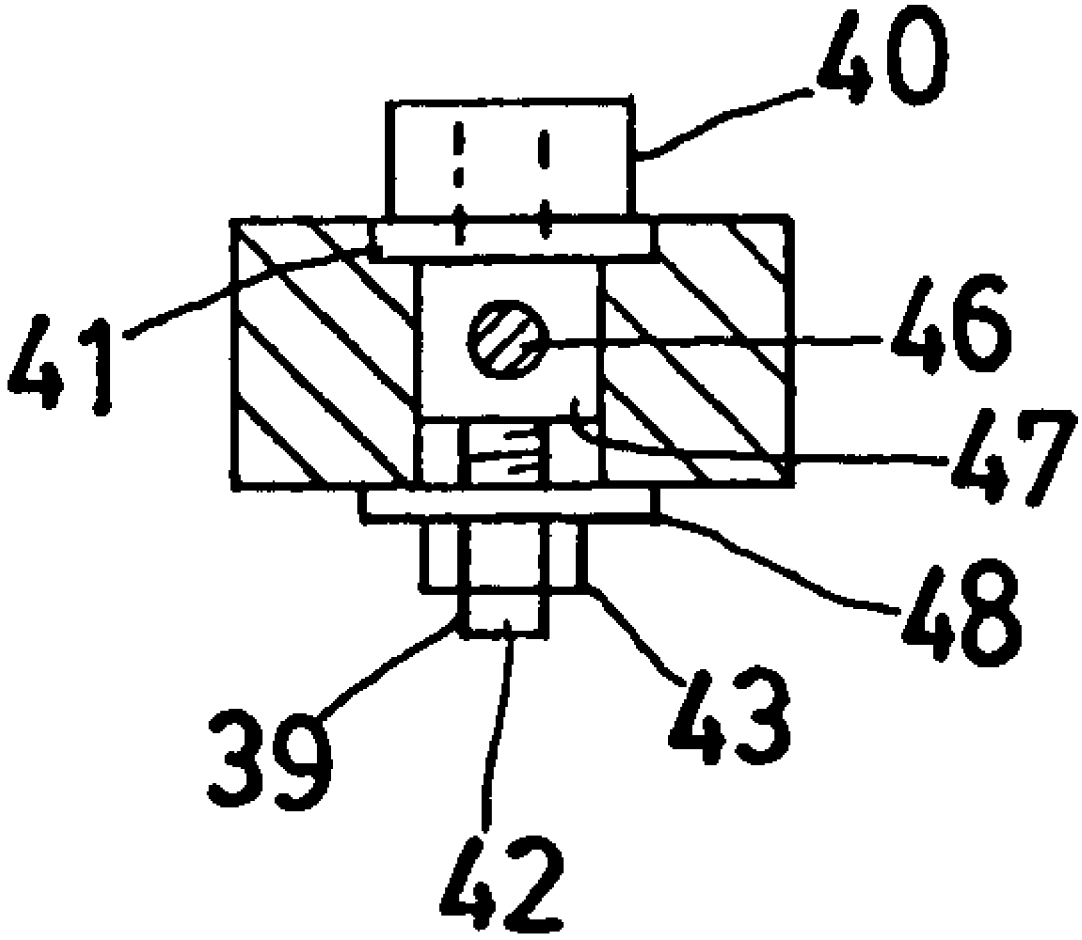
FIG. 5 is a cross sectional view along a line V—V in FIG. 4.

FIGS. 4 and 5 show a modified embodiment of the cutter mounting oscillating arm 23. In this case, the same members as the members shown in FIGS. 1 to 3 are denoted by the same reference numerals.

A screw 46 is rotatably provided in the cutter mounting oscillating arm 23 so as to be in parallel to the slit 37, a female thread body 47 is screwed to the cutter mounting oscillating arm 23, and the flange 41 and the screw 42 are provided in the female thread body 47. In other words, the female thread body 47 is formed as one of constituting members of the sliding member 39. In this case, the female thread body 47 is fitted to the slit 37 with no play in the width direction. Further, a washer 48 is fitted to the screw 42, and the nut 43 is fitted to the screw 42 so as to be positioned in front of the washer 48. In accordance with the structure mentioned above, it is possible to change a position of the female thread body 47 (the sliding body 40) by rotating the screw 46 in the state in which the nut 43 is loosened.

A description will be additionally given below of the modified embodiment.

(1) The structure may be made such that the sliding element 40 is provided in the connection rod 32 so as to be changed in position along the longitudinal direction, and the guide groove 35 is provided in the upper portion 23*a* of the cutter mounting oscillating arm 23.

(2) In this specification, the guide groove 35 includes a slit.

INDUSTRIAL APPLICABILITY

The present invention can be used for cutting the wire rod serving as the raw material of the various products.

What is claimed is:

1. A wire rod cutting apparatus of a spring manufacturing machine for manufacturing a spring by discharging a wire rod to a wire rod processing space provided in front of a front wall of a machine casing from a final wire rod guide provided in the front wall, and applying a predetermined process to the wire rod which is discharged to the wire rod processing space or is being discharged to the wire rod processing space, by a tool which protrudes or is protruding to the wire rod processing space, wherein the wire rod cutting apparatus has a slide which is slidably provided in the front wall so as to slide in the direction orthogonal to a center line of a wire rod passage of the final wire rod guide, a cutter mounting oscillating arm which is provided in the slide so as to freely oscillate by a pivot shaft having an axis directed in the longitudinal direction, and an actuating apparatus which slides said slide and oscillates the cutter mounting oscillating arm, wherein said actuating apparatus has a rotation shaft which is in, parallel to the pivot shaft, an eccentric pin which is directly or indirectly provided in the rotation shaft, is eccentric from the center of the rotation shaft and is in parallel to the rotation shaft, a connection rod which is pivotally attached to the eccentric pin in one end, and a connection pin which is provided in the slide in parallel to the eccentric pin and is pivotally attached to the other end of the connection rod, wherein a sliding element is provided in any one of said connection rod and the cutter mounting oscillating arm portion opposing to the connection rod, and a guide groove to which the sliding element is fitted with no play in the width direction is formed in the other thereof, wherein one end of said guide groove is directed to the eccentric pin and the other end thereof is directed to the pivot shaft, and wherein said sliding element is changeable in position so as to allow to change a distance with respect to the pivot shaft.

* * * * *